United States Patent [19]

Patton et al.

[11] 4,222,545

[45] Sep. 16, 1980

[54] ARTIFICIAL CHRISTMAS TREE STAND

[76] Inventors: Roy D. Patton, 221 Heritage Pl., Mooresville, N.C. 28115; Frank P. Rietveld, 1314 Vickie La., Matthews, N.C. 28105

[21] Appl. No.: 942,796

[22] Filed: Sep. 15, 1978

[51] Int. Cl.[2] ..... A01K 97/10; A45B 25/28; A47G 25/12

[52] U.S. Cl. ..... 248/524; 248/158

[58] Field of Search ..... 248/523, 524, 346, 158, 248/535, 357

[56] References Cited

U.S. PATENT DOCUMENTS

| | | | |
|---|---|---|---|
| 1,805,095 | 5/1931 | Horni | 248/523 X |
| 1,856,000 | 4/1932 | Smith | 248/346 X |
| 2,337,914 | 12/1943 | Meldrum | 248/524 X |
| 2,613,899 | 10/1952 | Wagner et al. | 248/524 X |
| 2,980,377 | 4/1961 | Nielsen et al. | 248/523 |
| 3,302,909 | 2/1967 | Glassman | 248/524 X |
| 3,380,314 | 4/1968 | Halsted | 248/632 X |
| 4,130,965 | 12/1978 | Patton | 248/524 X |

FOREIGN PATENT DOCUMENTS

| | | | |
|---|---|---|---|
| 2658378 | 6/1978 | Fed. Rep. of Germany | 248/524 |
| 1017771 | 5/1963 | United Kingdom | 248/346 |

*Primary Examiner*—J. Franklin Foss

*Attorney, Agent, or Firm*—Harry R. Dumont

[57] ABSTRACT

The stand is of a general hemispheric configuration. It is dimensioned with an adapter to handle a broad range of stem sizes and heights of artificial Christmas trees. A principal feature of the stand is the quick mounting and quick release that is made possible by the adapter which is readily expanded or reduced in its diameter when the tree trunk is inserted or removed.

6 Claims, 5 Drawing Figures

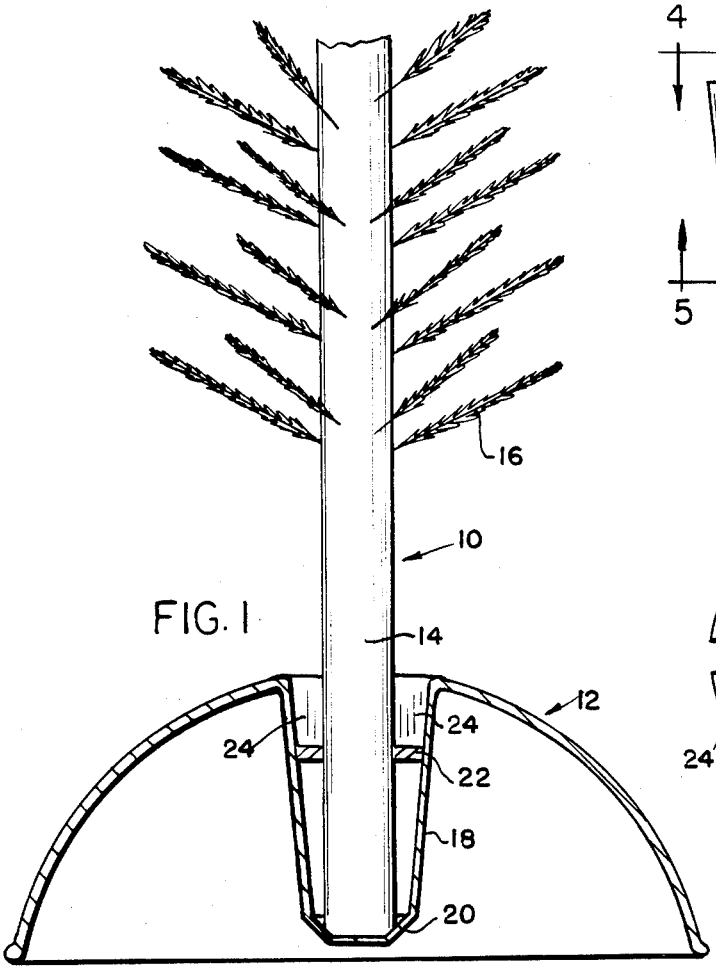
FIG. 1
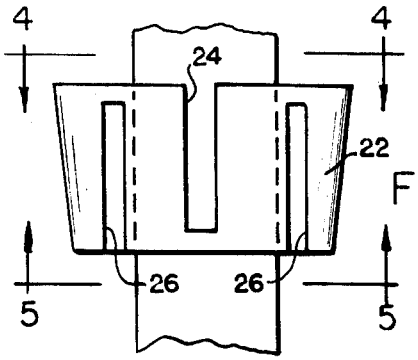
FIG. 3
FIG. 4
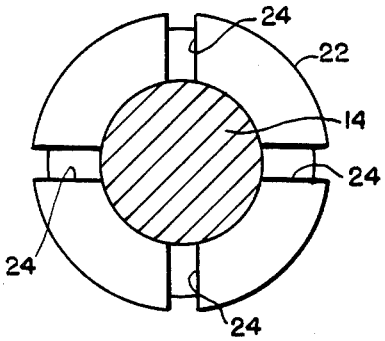
FIG. 5
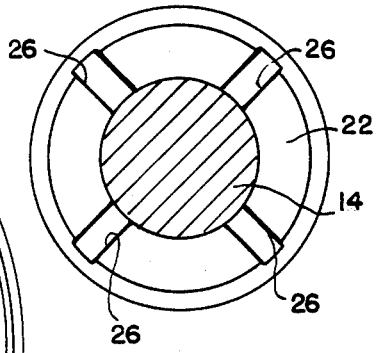
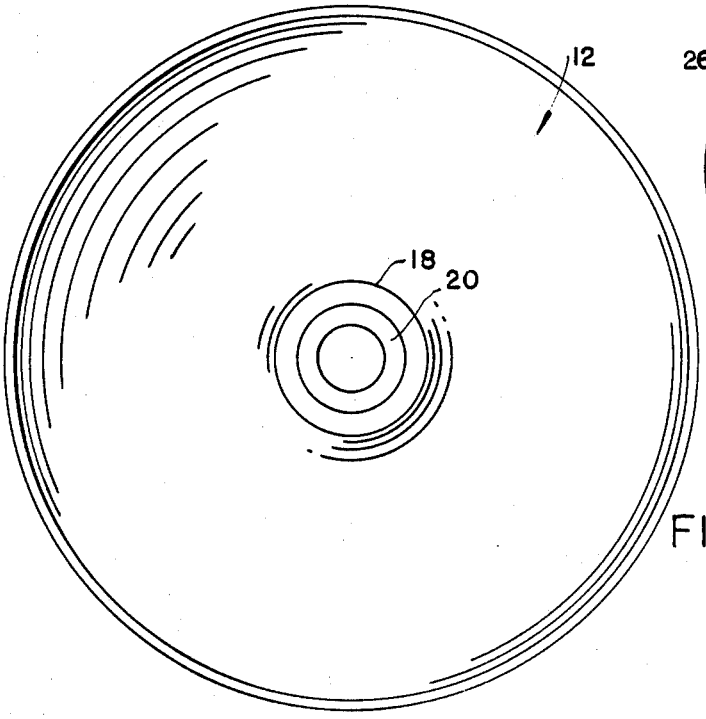
FIG. 2

ARTIFICIAL CHRISTMAS TREE STAND

BACKGROUND OF THE INVENTION

This invention provides a symmetrical and attractive stand for holding artificial Christmas trees of a broad range of sizes and heights. There is a problem in providing a Christmas tree holder that is both simple, attractive to look at, and easy to dismantle and store when not in use. A number of prior art devices are known for holding either real or artificial Christmas trees in which the clamping devices incorporated in the stand may be described as generally pivotally retained and in which the locking is achieved through a tilting movement of each of the gripping legs. Examples of this type of holder are shown in Danner, U.S. Pat. No. 1,714,498 issued on May 28, 1929 for "Christmas Tree Holder"; Krick, U.S. Pat. No. 694,867 issued on Mar. 4, 1902 for "Stand"; and Hollander, U.S. Pat. No. 2,014,896 issued on Sept. 17, 1935 for "Christmas Tree and Staff Holder". The prior art devices are subject to the problem that a low center of gravity is not maintained to provide a stable mounting. In most cases, complex threaded or other clamping devices are required to fasten the tree stem to the base. Also, it will be seen from the known prior art that Christmas tree stands generally contain a number of connecting and coacting parts and are thus not attractive so that they require decorative coverings of paper and the like in order to make them presentable for use in the house.

BRIEF SUMMARY OF THE INVENTION

The present invention includes a stand with a central opening having a tapered bottom and a tapered adapter which is slidably moveable up and down the artificial tree stem to allow the trunk to seat on the tapered bottom formed in the stand. The tapered adapter is then pushed downwardly on the stem and into the central opening. It then tightens about the stem and in the tree stand at the same time. Then, if a downward pressure is applied to the stand and an upward lifting movement is applied to the stem at the same time, the tree stem will readily become released for disassembly.

BRIEF DESCRIPTION OF THE DRAWINGS

Reference is now made to the accompanying drawings forming a part of this specification in which similar characters and numerals of reference represent corresponding parts in all the different figures and in which:

FIG. 1 is an elevational view of the apparatus showing the stand in cross section;

FIG. 2 is a top plan view of the stand with the tree removed;

FIG. 3 is a side elevational view showing the adapter used with the stand;

FIG. 4 is a sectional view taken along the section line 4—4 of FIG. 3; and FIG. 5 is a sectional view taken along the section line 5—5 of FIG. 3.

DESCRIPTION OF THE PREFERRED EMBODIMENT

FIG. 1 shows an artificial Christmas tree 10 fixed in a stand 12. The tree 10 includes a stem 14 and a number of limbs 16 which may or may not be removable to facilitate storage. It will be seen that the stand 12 is of a generally hemispheric configuration and it is typically formed from a high strength plastic material. The stand 12 further includes a centrally located, tapered opening 18 having a tapered bottom portion 20. The stem 14 is retained in place in the opening 18 by the action of a collar 22 better shown in FIGS. 3–5 hereinafter. The collar adapter 22, as best shown in FIGS. 3–5, includes a plurality of downwardly extending, rectangular cutout portions 24. FIGS. 4 and 5 show these to be four in number but the invention is not limited to this exact embodiment. Three or perhaps five may be used depending on the resilience of the material of the adapter 22. It will be understood that the adapter 24, in its unrestricted or free condition, is freely slidable up and down the tree stem 14.

As best shown in FIG. 5, the lower edge of the collar 22 also includes a plurality of upwardly disposed, rectangular cutout portions 26. While FIG. 5 shows the cutout portions 26 to be four in number, the invention is not so limited but three, five or perhaps different numbers could be used. It will also be seen that the outside periphery of the collar 22 is itself downwardly tapered. This facilitates introduction of the collar into the opening 18 of the stand 12.

In inserting the tree 10 into the stand, the adapter 22 is first slid upwardly on the stem 14. The bottom of the stem 14 is then inserted into the opening 18 until it seats on the tapered bottom 20. The adapter is then pushed downwardly on the stem 14 into the upper end of the opening 18. This will cause the adapter 22 to tighten both against the periphery of the opening 18 and about the periphery of the tree stem 14. This insures a secure seating of the end of the stem 14 in the stand 12. The entire assembly is readily releasable by simply lifting up on the tree stem 14 and application of a slight pressure of hand or foot against the upper surface of the stand 12.

It will thus be seen that we have provided by our invention a greatly improved and simplified stand for artificial Christmas trees or the like.

We claim:

1. A stand for an artificial Christmas tree and the like comprising:

a base;

a downwardly tapered opening formed in said base;

a collar having its periphery downwardly tapered in a manner complementary with said opening, said collar having a plurality of spaced, downwardly disposed elongated openings formed in its upper edge and a plurality of upwardly disposed elongated openings formed in its lower edge, said openings in the lower edge circumferentially displaced with respect to said openings in the upper edge, said collar further having a central opening formed in it whereby it may be slipped onto the stem of a tree to be mounted preliminary to its insertion in said base opening.

2. The combination as set forth in claim 1 wherein said collar opening further includes aa lower tapered bottom portion for holding the end of the tree stem in place.

3. The combination as set forth in claim 1 wherein said openings formed in said collar edges are of a rectangular cut-out configuration.

4. The combination as set forth in claim 1 wherein said openings are substantially equally spaced, one from the other, around said upper and lower edges.

5. The combination as set forth in claim 1 wherein said base is of a hemispheric shape and wherein said base central opening is formed proximate the center of said base.

6. The combination as set forth in claim 1 wherein said openings are four in number and substantially equally spaced about both the upper and the lower edges of said collar, respectively.

* * * * *